US006642898B2

(12) United States Patent
Eason

(10) Patent No.: US 6,642,898 B2
(45) Date of Patent: Nov. 4, 2003

(54) FRACTAL CROSS SLOT ANTENNA

(75) Inventor: Steven D. Eason, Largo, FL (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 10/146,455

(22) Filed: May 14, 2002

(65) Prior Publication Data

US 2002/0175874 A1 Nov. 28, 2002

Related U.S. Application Data

(60) Provisional application No. 60/291,204, filed on May 15, 2001.

(51) Int. Cl.[7] ..... H01Q 13/10
(52) U.S. Cl. ..... 343/770; 343/767
(58) Field of Search ..... 343/767, 770, 343/700 MS, 771, 772

(56) References Cited

U.S. PATENT DOCUMENTS

| | | | | |
|---|---|---|---|---|
| 3,530,479 A | * | 9/1970 | Waldron | 343/771 |
| 4,916,457 A | | 4/1990 | Foy et al. | 343/770 |
| 4,958,165 A | | 9/1990 | Axford et al. | 343/770 |
| 5,187,490 A | | 2/1993 | Ohta et al. | 343/770 |
| 5,581,266 A | | 12/1996 | Peng et al. | 343/770 |
| 5,815,122 A | * | 9/1998 | Nurnberger et al. | 343/767 |
| 5,872,545 A | | 2/1999 | Rammos | 343/770 |
| 5,914,695 A | | 6/1999 | Liu et al. | 343/795 |
| 6,061,032 A | * | 5/2000 | Sandstedt et al. | 343/770 |
| 6,140,975 A | | 10/2000 | Cohen | 343/846 |
| 6,400,322 B2 | * | 6/2002 | Fang et al. | 343/700 MS |
| 6,452,553 B1 | * | 9/2002 | Cohen | 343/702 |
| 2002/0122009 A1 | * | 9/2002 | Winebrand et al. | 343/767 |

FOREIGN PATENT DOCUMENTS

| | | | |
|---|---|---|---|
| EP | 0 317 414 A1 | 5/1989 | H01Q/21/24 |

OTHER PUBLICATIONS

PCT International Search Report dated Jul. 18, 2002 for PCT/US 02/15646 filed May 15, 2002, Jul. 18, 2002.

"*S–Line Cross Slot Antenna*", Specification, Claims, and Abstract (22 pages), 29 pages of drawings, inventors Ofira M. Von Stein, et al, U.S. patent application Ser. No. 09/832, 577, filed Apr. 11, 2001, Attorney Docket No. 064750.0434.

Gianvittorio, John P. and Rahmat–Samii, Yahya, "*Fractal Loop Elements in Phased Array Antennas: Reduced Mutual Coupling and Tighter Packing*", IEEE 0–7803–6345–0/00, 2000, pp. 315–318. 2000.

* cited by examiner

*Primary Examiner*—Tan Ho
(74) *Attorney, Agent, or Firm*—Baker Botts L.L.P.

(57) ABSTRACT

A fractal cross slot broad band antenna comprises a five layer configuration including a radiating fractal cross slot layer having a plurality of antennas each comprising a plurality of radiating arms. Positioned adjacent one side of the fractal cross slot layer is a first spacer layer configured to define a cavity. A microstrip coupled feed layer having feeds equal in number to the plurality of radiating arms is positioned adjacent to the first spacer layer. A second spacer layer is positioned adjacent the feed layer and is configured to also define a cavity. The fifth layer, a ground plane layer, has a copper clad surface and is positioned adjacent the second spacer layer.

25 Claims, 6 Drawing Sheets

FRACTAL CROSS SLOT ANTENNA

RELATED APPLICATION

This application claims the benefit of U.S. provisional application Ser. No. 60/291,204, filed May 15, 2001, entitled Fractal Cross Slot Antenna.

TECHNICAL FIELD OF THE INVENTION

This invention relates to a fractal cross slot antenna, and more particularly to a fractal cross slot antenna having reduced size, and bandwidth enhancement with a small slot width. When arrayed these features enable reduced element-to-element coupling.

BACKGROUND OF THE INVENTION

The Global Positioning System (GPS) has begun to permeate every aspect of the military and commercial sectors, with new applications being proposed each day. For the military, GPS has become a significant, enabling technology for the present and future war fighter. This technology is becoming part of almost every aspect of the military and is forming the foundation for new paradigms in wartime tactics. As a result, the U.S. military is increasingly utilizing GPS.

There are a number of challenges associated with designing and producing good antenna elements and arrays for military GPS and commercial applications. Size, performance, cost, and weight are all generally significant issues when designing for a military application (war fighter, aircraft, submarine, ship, etc.). When working with antennas, these requirements can be mutually exclusive. For instance, optimum antenna performance is predicated upon a given antenna size and many techniques used to reduce the size of the antenna require a trade-off of some, or all, of other antenna requirements.

With proliferation of GPS, and the desire to outfit more and varied types of platforms, comes a need for small, low cost, lightweight GPS antenna elements and conformal arrays. In order to produce a low profile, reduced size, conformal GPS array, there is needed small, slim elements that can be spaced less than ½ wavelength apart within an array without a significant degradation in individual element performance. These requirements limit the element type options, and often the possible array configurations.

Most existing GPS array designs utilize microstrip patch antenna elements. These elements are attractive because of relatively simple designs that exhibit a low profile, and have well understood performance characteristics. Often these patch elements, and associated arrays, are fabricated using expensive microwave substrate materials such as Duroids (PTFE), Alumina, and TMM. While these materials provide excellent low loss mediums, they can add significant cost and weight to the final design. In addition, the narrow band (High Q) response of the patches coupled with material and manufacturing tolerances can lead to elevated element and array costs.

One element option having a low profile, low cost, light weight as an alternative to the patch element is the cross slot. While the cross slot tends to be overlooked because of its relatively directive radiation pattern, the cross slot provides one of the few conformal alternatives to the patch. A more directive radiation pattern may prove to be a benefit for the auxiliary elements in a reduced size (smaller than optimal electrical size) Controlled Reception Pattern Antenna (CRPA) array. More cross slot elements can be packed closer together without excessive element-to-element coupling. In addition, the cross slot has the benefit of allowing the elements to be somewhat "interleaved"—which further aids in "packing" the elements within the array. However, challenges with the cross slot design still exist. One significant challenge is the difficulty in reducing the size of the element with dielectric loading and still maintain adequate feed-slot coupling.

The most common way to reduce the size of an element operating at high RF or microwave frequencies is to load it with a material that has a high permittivity or dielectric constant. This dielectric "loading" reduces the propagation velocity for a wave in that medium, and consequentially, the element's effective electrical length. The basic relationship between the wavelength in the dielectric ($\lambda_d$) and the wavelength in air ($\lambda_O$) is given by equation (1).

$$\lambda_d := \frac{\lambda_o}{\sqrt{\varepsilon_{eff}}} \tag{1}$$

Where ($\epsilon_{eff}$) is the effective relative dielectric constant—which takes into account the dielectric constant of the material and the associated electromagnetic field distribution.

While dielectric loading can effectively reduce the size of the element, it does come at a price. One must consider the changes in electrical properties associated with a given amount of dielectric loading. At a minimum, dielectric loading reduces the bandwidth and efficiency of an antenna (as well as adding weight and cost). The amount of bandwidth and efficiency lost will depend upon the material properties of the dielectric chosen, and the amount of reduction attempted. For very narrow band elements, such as microstrip patches, the loss of bandwidth coupled with manufacturing and material tolerances can be a real production problem. For this reason, a broadband, reduced size element that requires no (or less) dielectric loading could be a real plus.

Published studies describe how fractal concepts can be applied to antenna elements as a means to reduce the effective (tip-to-tip) length of elements, alter the antenna input impedance, and/or enhance antenna bandwidth without a significant reduction in element performance. Conceptually, the fractal "bending" facilitates a more efficient "packing" of the conductor and gives rise to a distributed reactive loading.

When an antenna element is placed within a multiple element array, the element performance will be altered due to the presence of the other elements. This alteration, which is seldom for the better, can include perturbations in the current distribution and radiated field of an element, as well as a significant change in the input impedance of the element. This element interaction is generally characterized by measuring how much of the signal of one element is coupled into adjacent elements. This quantity, termed mutual coupling, gives an indication of how much the performance of an element will be affected by the presence of the adjacent elements. As the mutual coupling increases, the performance of the elements and an array will steadily degrade.

Typically, elements within an array are spaced at least ½ wavelength apart. There are a number of reasons for this spacing. First, and most basic, most resonant elements are close to ½ wavelength in size. If two adjacent elements are put closer than the size of an element, they will physically touch. The second is that even if the element is made smaller such that it does not physically touch and can be moved closer, the mutual coupling between two adjacent elements increases as the spacing decreases. Element-to-element spacing of ½ wavelength or greater tends to provide acceptable coupling levels in most designs. While somewhat design dependent, coupling values of −15 to −20 dB or better are preferred.

Fractal antenna elements might in some cases aid in the reduction of mutual coupling by reducing the element size and, in the case of the fractal slot, by confining the element fields to a narrow slot width. Gianvittorio and Rahmat-Samii (J. P. Gianvittorio and Yahya Rahmat-Samii, "Fractal Loop Elements in Phased Array Antennas: Reduced Mutual Coupling and Tighter Packing", IEEE, 2000) show how a 5-element array of small fractal loop elements could be used to reduce the mutual coupling effects to facilitate a larger scan volume. It is also possible that in certain cases the meandering of the fractal elements may provide a form of "random" element clocking, thus contributing to lower mutual coupling.

SUMMARY OF THE INVENTION

The single slot type of antenna is a variation of the basic dipole antenna. Each side of the slot acts as one node of an elementary dipole. The length and separation dimensions of the slot are selected to maximize performance (fraction of a wavelength).

A fractal cross slot antenna has two orthogonal intersecting fractal crossed slots in a cavity backed conductive element where each leg of each slot is excited by an RF signal from a feed providing four RF inputs of 0°, 90°, 180°, and 270° to achieve circular polarization.

In accordance with one embodiment of the present invention, a fractal cross slot broadband antenna comprises a radiating cross slot layer having at least one antenna element comprising a plurality of unit cells. A first spacer layer configured to define a cavity is positioned adjacent one side of the radiating layer wherein the cavity generally outlines the pattern of the plurality of unit cells. A transmission feed layer having feed transmission lines equal in number to the at least one antenna element is positioned adjacent the first spacer layer and a second spacer layer also configured to define a cavity is positioned adjacent to the transmission feed layer. In addition, the fractal cross slot broad band antenna comprises a ground plane layer having a copper clad surface, where the ground plane layer is positioned adjacent the second spacer layer.

Also in accordance with the present invention there is provided a fractal cross slot broad band antenna array comprising a radiating cross slot layer having a plurality of cross slot antennas, each cross slot antenna comprising a plurality of antenna elements of a plurality of unit cells to form an array of fractal cross slot antennas. A first spacer layer configured to define a cavity in proximity to each of the plurality of antenna elements is positioned adjacent one side of the radiating layer. Positioned adjacent the first spacer layer is a transmission feed layer having transmission lines equal in number to the plurality of antenna elements for each of the plurality of cross slot antenna. A second spacer layer also configured to define a cavity for each of the plurality of antenna elements is positioned adjacent to the transmission feed layer. Positioned adjacent the second spacer layer is a ground plane layer having a copper clad surface.

Technical advantages of the present invention include providing a fractal cross slot antenna constructed utilizing common, and low cost materials relative to the microwave substrates typically utilized. Further, size reduction and bandwidth enhancement (while maintaining a narrow slot width) is a technical advantage along with configuring the antenna to provide flush mounting of the antenna to non-planar surfaces. As a result, the fractal cross slot antenna has superior physical characteristics and electrical performance and presents a novel configuration for coupling energy to the slot type antenna.

BRIEF DESCRIPTION OF THE DRAWINGS

A more complete understanding of the fractal cross slot antenna of the present invention may be had by reference to the following detailed description when taken in conjunction with the accompanying drawings.

DETAILED DESCRIPTION OF THE DRAWINGS

Figure 1:
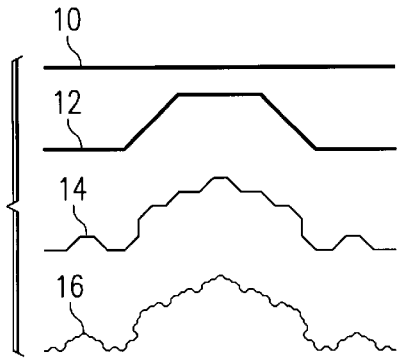
FIG. 1 illustrates several examples of fractal "bending" for the antenna elements in accordance with the present invention.

Referring to FIG. 1, a fractal cross slot antenna provides an alternative to dielectric loading for a smaller antenna (or may be used in conjunction with some small amount of dielectric loading). The conventional ½ wavelength resonant slot 10 is "bent" into a fractal pattern 12. Fractal patterns, such as pattern 12, have shown the possibility of reducing element size and enhancing bandwidth. The underlying mechanisms that accounts for the size reduction of a radiating element include the added length of a slot (see patterns 14 and 16) attributed to the meandering of the slot and/or reactive loading. Reactive loading is another mechanism that reduces the propagation velocity of a wave and thereby increases the electrical length of a transmission line (or element). As can be seen in the simplified equations (2) and (3), addition of more inductance (L) or capacitance (C) along a transmission line decreases the propagation velocity ($V_P$), and correspondingly, the effective wavelength ($\lambda_L$).

$$v_P := \frac{1}{\sqrt{L \cdot C}} \tag{2}$$

$$\lambda_L := \frac{v_P}{f} \tag{3}$$

The addition of bends and/or "stubs" along a fractal structure provides some amount of reactive loading (inductance and capacitance), and therefore contribute to the size reduction of a radiating element.

The fractal meandering can change the complex driving point impedance characteristics of a dipole (analogous to a slot), and thereby make a broader impedance match possible in some cases.

The fractal cross slot antenna provides reduced element-to-element coupling (versus a conventional tapered slot) when configured as an array. This is based upon the fact that the fractal cross slot is considerably narrower than that of the conventional flared non-fractal cross slot ($1/10^{th}$ to $1/20^{th}$ the width). Therefore, the fields within the fractal slot are more tightly contained and less apt to couple to neighboring elements (or be affected by nearby structures).

Figure 2:
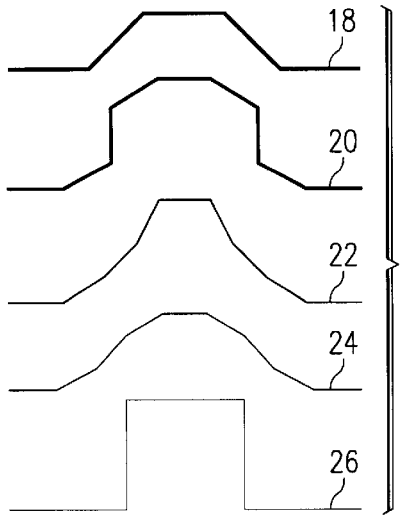
FIG. 2 illustrates basic patterns considered as candidates for fractal slot antennas in accordance with the present invention.

Referring to FIG. 2, the process of configuring a fractal cross slot antenna begins with the choice of the "bending pattern". In theory, the possibilities are infinite. FIG. 2 shows a number of the initial patterns. Criteria was established to determine which would be the best pattern for the "first-cut" at a fractal antenna.

The criteria for determining the "bending pattern" of a fractal cross slot antenna includes the following items.

(1) Maximize the number of bends per segment.

Since discontinuities in transmission lines tend to radiate, the addition of more discontinuities per segment enhances radiation over an element with fewer discontinuities.

An increased number of segments will also tend to "pack" more of the conductor (slot) into the same linear distance (original line length). This shifts the resonant frequency down (extra meandered line). Ultimately, this allows the structure to be made smaller (lengthwise) and still realize the original resonant frequency.

(2) Choose a bending scheme that allows for at least 3 fractal iterations.

Since the scaled self-similar nature of the fractal is (at least in part) responsible for bandwidth enhancement it is important to have enough iterations to achieve an enhanced antenna.

If the chosen pattern provides too many bends then the segment lengths of the resulting 3-iteration basic structure (see element 12) would be difficult to fabricate and/or would not allow for good fractal pattern resolution (width of the slot would become a problem).

Fabrication capabilities (10–15 mils for board router) and the slot width-to-length aspect ratio bound the minimum segment size.

In order to maintain a good overall fractal pattern the minimum segment slot length should be no less thank the slot width. Since bandwidth is also affected by slot width, the slot width should not go below approximately 25 mils. The resulting minimum segment slot length is then approximately 12 mils.

(3) Choose a pattern that would not close upon itself.

Referring to FIGS. 3A, 3B, 3C and 3D, the resulting fractal pattern should have a single continuous slot (path) that does not branch or fork to multiple paths at any point. A branching likely will destroy the resonant nature of the structure.

Figure 3A:
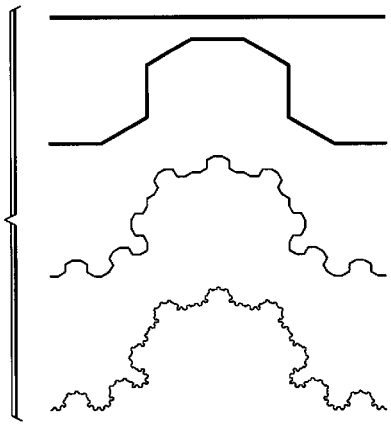
FIGS. 3A, 3B, 3C and 3D illustrate four alternative fractal patterns as candidates for a fractal slot antenna in accordance with the teachings of the present invention.
Figure 3B:
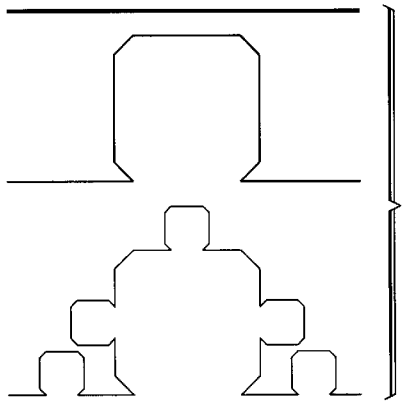
Figure 3C:
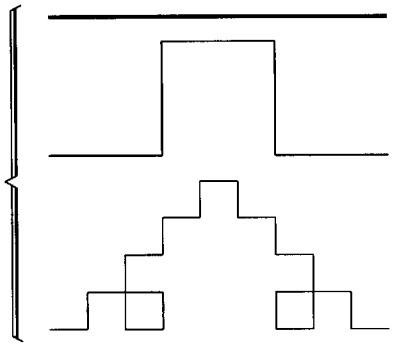
Figure 3D:
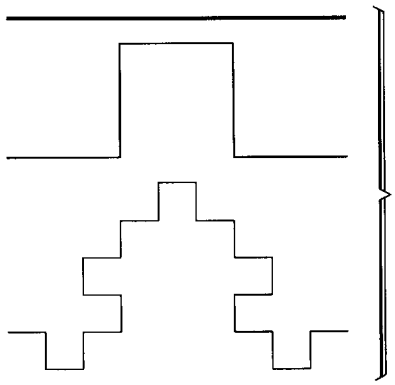

FIG. 3D illustrates details of four embodiments for the patterns for a fractal cross slot antenna that satisfy the three criteria items described above.

Referring again to FIG. 2, the slot patterns 20, 22 and 24 were removed from contention as a pattern for a fractal cross slot antenna because each resulted in segment sizes that violated the minimum segment length criteria. The pattern 26 was excluded because it closed in upon itself (an alternate configuration shown in FIG. 3(D) was considered—but is less straight forward than preferred alternative embodiments). Slot pattern 18 was determined to be the preferred embodiment based upon the established criteria.

Figure 4:
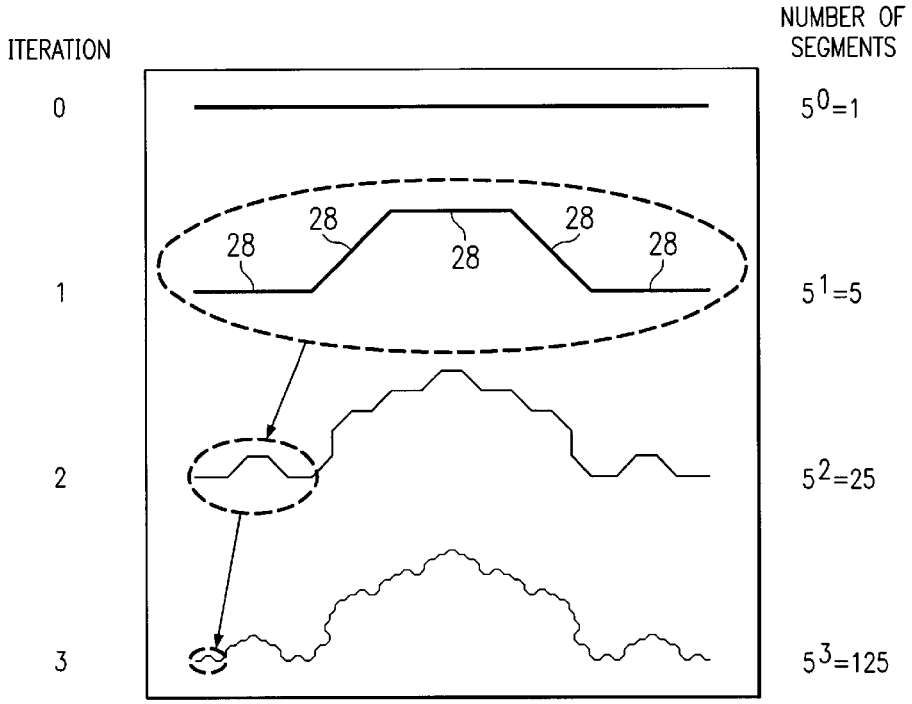
FIG. 4 illustrates a three iteration fractal slot unit cell in accordance with a preferred embodiment of the present invention.

Referring to FIG. 4, there is illustrated a larger view of the three iterations for the fractal slot pattern 18. This figure shows how the basic pattern of a unit cell is scaled and how the total number of segments 28 in a unit cell (iteration 1) increases with increasing fractal iterations 2 and 3. As illustrated, the unit cell of iteration 1 has five segments 28, iteration 2 has five unit cells and twenty-five segments 28, and iteration 3 has twenty-five unit cells and one-hundred twenty-five segments 28.

Figure 5:
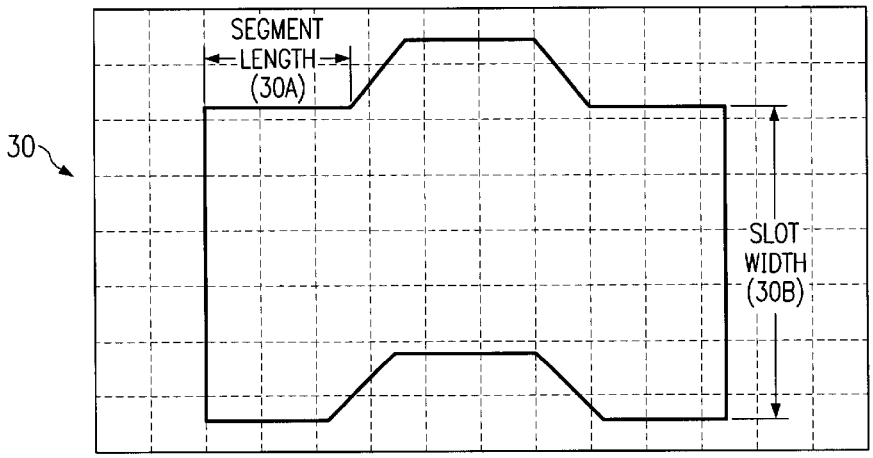
FIG. 5 illustrates a basic fractal unit cell for constructing a fractal cross slot antenna.

Referring to FIG. 5, the implementation of the pattern required that a basic unit cell 30 be constructed and was subsequently used as an antenna element for a fractal cross slot antenna. The size of the unit cell 30 was determined by calculating the segment length 30A after three iterations for the chosen pattern and including the desired slot width 30B.

Figure 6:
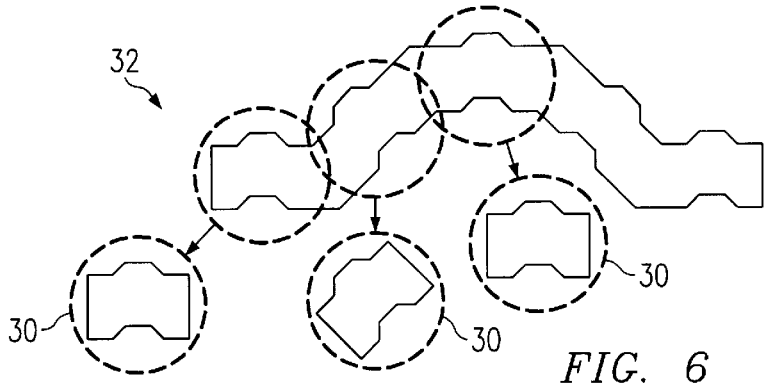
FIG. 6 is an illustration of a fractal pattern constructed utilizing the basic fractal unit cell of FIG. 5.
Figure 7:
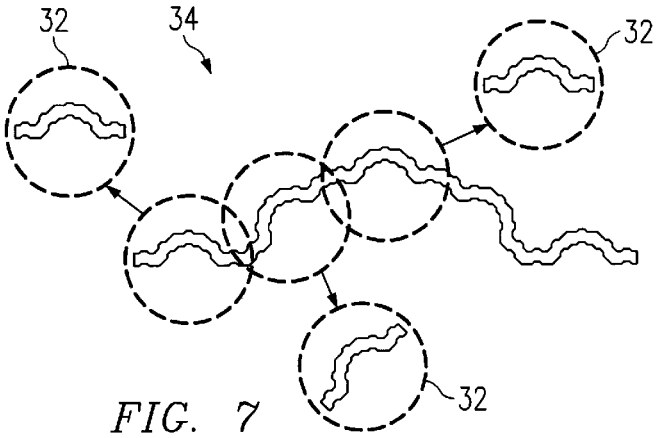
FIG. 7 illustrates the next larger iteration and pattern for the fractal cross slot antenna element as illustrated in FIG. 6.

Referring to FIGS. 6 and 7, these figures illustrate use of the basic unit cell 30 of FIG. 5 to construct the subsequent (larger) multiple unit cells 32. The multiple unit cells 32 being used for the fractal slot antenna element 34 (more detail to follow). The slot antenna element 34 was then used as the building block for the fractal cross slot antenna 36 shown in FIG. 8.

Figure 8:
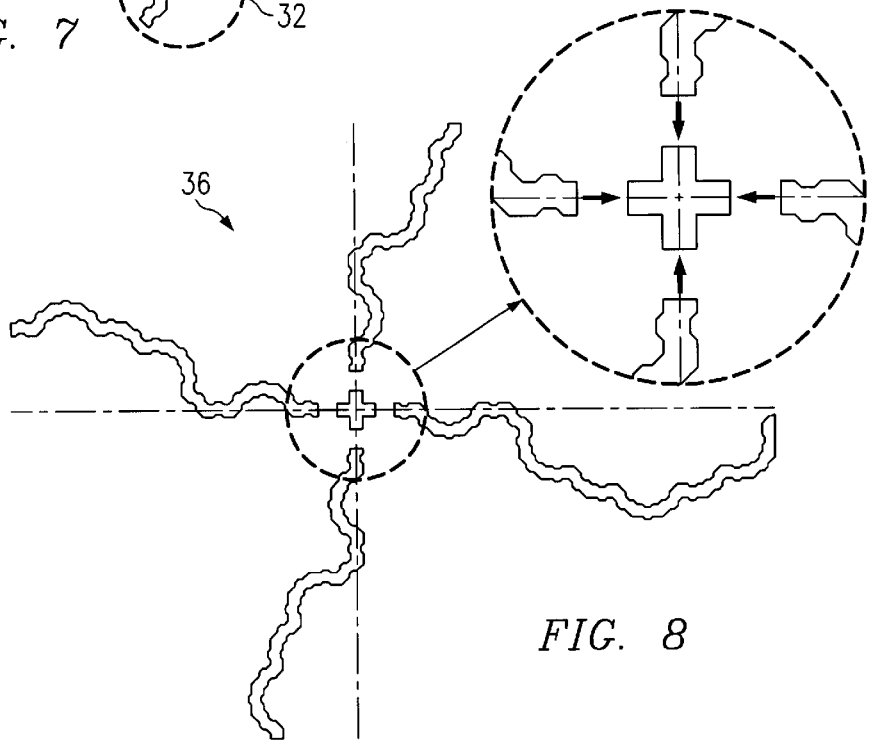
FIG. 8 is an illustration of four fractal cross slot antenna elements utilizing the basic fractal unit cell of FIG. 5.
Figure 10:
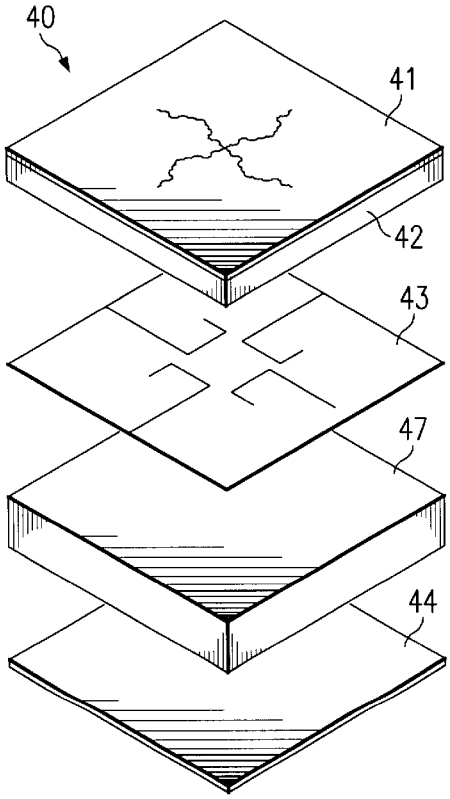
FIG. 10 is an exploded view of the layers of the fractal cross slot antenna including the radiating fractal cross slot layer, a first spacer layer, a feed layer, a second spacer layer, and a ground layer, respectively.
Figure 11:
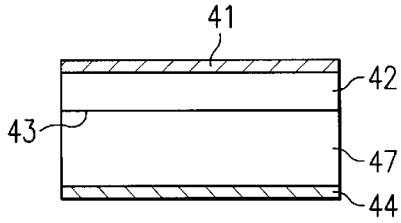
FIG. 11 is a side view of the layered configuration for the fractal cross slot antenna of FIG. 10.

Referring to FIGS. 10 and 11, there is illustrated a microstrip-coupled fractal cross slot antenna 40 fabricated in accordance with the present invention. The antenna utilizes the origin-symmetric cross slot antenna 36 as shown in FIG. 8 and is constructed in layers as shown exploded in FIG. 10 and assembled in FIG. 11. The top layer 42 consisted of 60 mil thick FR4 with a 48 mil wide fractal cross slot 41 milled on one side and microstrip feed lines 43 on the other. The top layer 42 is separated from the ground plane 44 by a 0.5" thick section 47 of Rohacell foam. The fractal cross slot 41 comprises four antenna elements 34 (see FIG. 7), each comprising a plurality of unit cells 30 (see FIG. 5).

Figure 12:
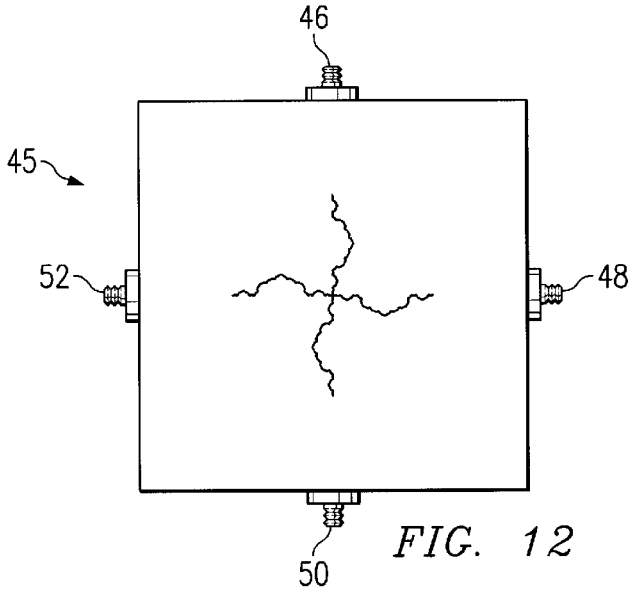
FIG. 12 is a top view of the upper surface of a fractal cross slot antenna having transmission feeds coupled to each of the four arms of the antenna element.

A fractal cross slot antenna 45, as shown in FIG. 12, illustrates one embodiment of the invention and is matched (empirically) to cover a band that extended from the GPS L2 frequency (1227 MHz) through the GPS L1 frequency (1575 MHz). The end-to-end length of a single slot arm was 2.6"(0.27λ@L2).

Referring to FIG. 12, there is shown the fractal slot cross slot antenna 45 having horizontal coaxial inputs 46, 48, 50 and 52. Slot width, length and shape govern the resonant frequency of the antenna where an increase in slot length decreases the resonant frequency. Slot width influences the bandwidth versus radiation efficiency. The transmission feed lines 43 such as illustrated in FIG. 10 are coupled to each leg of the fractal cross slots of the antenna 45. The transmission feed location establishes the driving point impedance while the width, length and shape impact bandwidth resonant frequency, and complex impedance characteristics for the antenna.

Figure 13A:
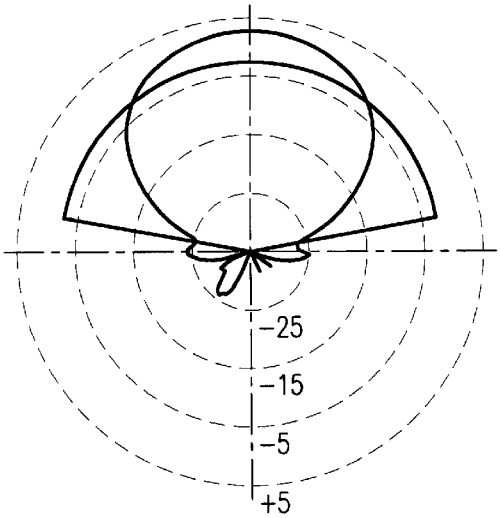
FIGS. 13*a* and 13*b* illustrate fractal cross slot patterns at conventional GPS frequencies for the antenna of FIG. 12.
Figure 13B:
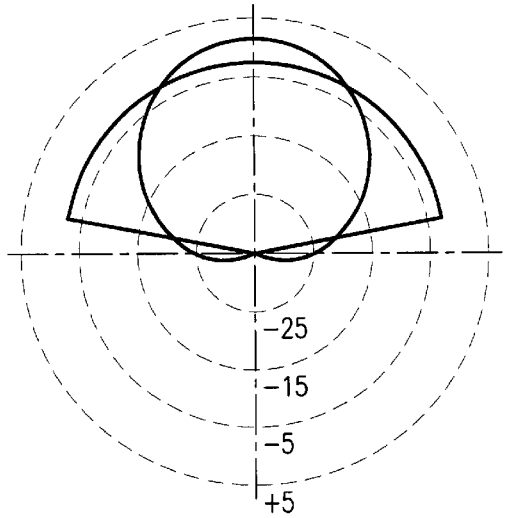

Referring to FIGS. 13(*a*) and 13(*b*), there is illustrated the radiation patterns for the antenna 45 of FIG. 12 taken at the two GPS frequencies. Since the antenna 45 was fed in phase quadrature, a direct return loss measurement would not be worthwhile, and therefore was not taken. Consequently, bandwidth is estimated to be at least 25% (at the gain levels shown in the figures). This estimate was based upon the radiation patterns taken at the two GPS frequencies and lab measurements.

Figure 14:
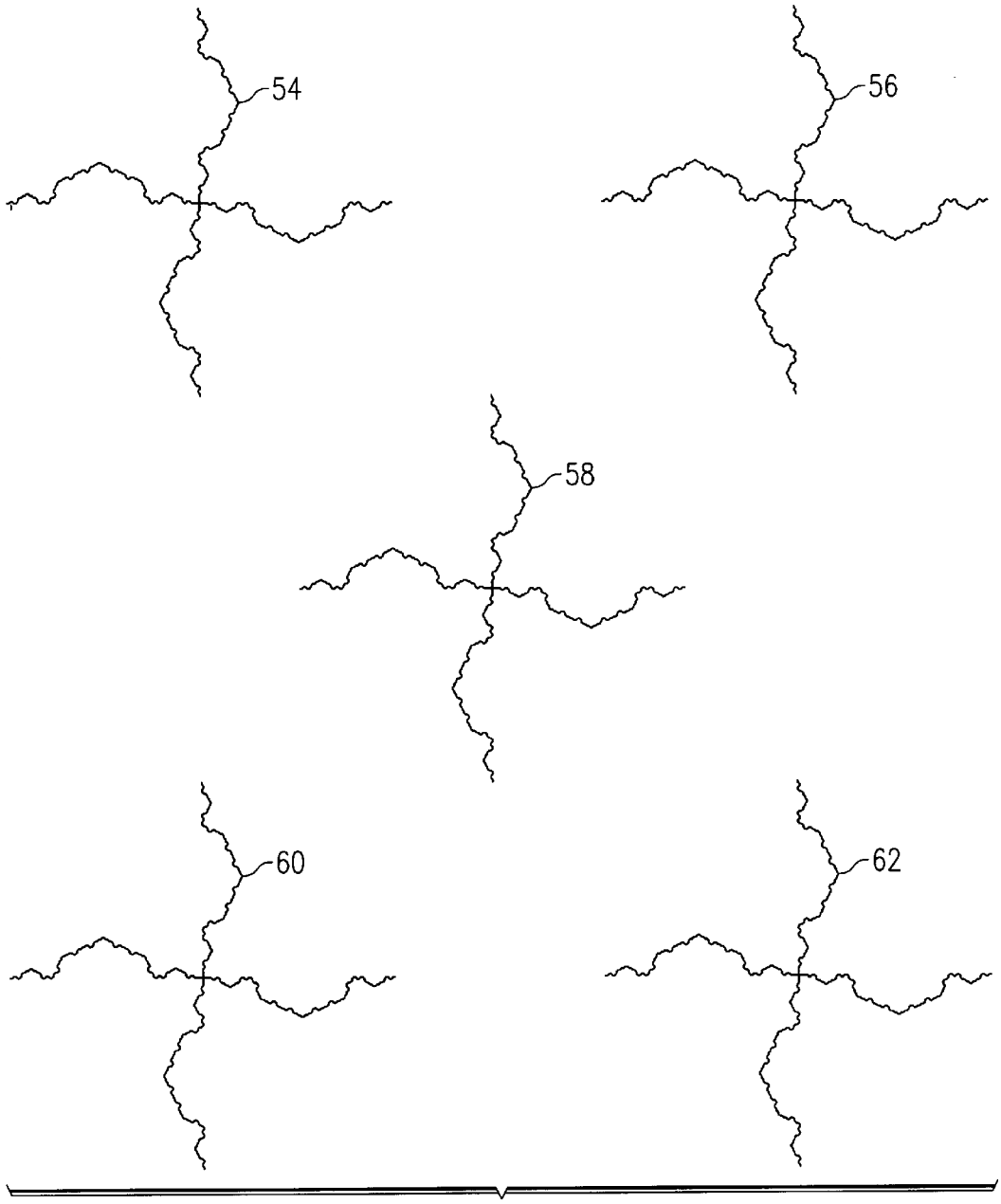
FIG. 14 is a top view of a five cross slot antenna array for broad band applications with vertical feed inputs.

Referring to FIG. 14, there is illustrated an array of five fractal cross slot antennas for broad band (L1–L2, 30% BW), with vertical feed (not shown). The plurality of fractal slots of each of the cross slot antennas 54, 56, 58, 60 and 62 have a configuration as illustrated in FIG. 8. The construction of the antenna as illustrated in FIG. 14 employs the layered configuration as illustrated in FIGS. 10 and 11. The layered structure includes a radiation cross slot layer 41, a ground plane layer 44, a feed layer 43 and spacer layers 42, 47.

While not depicted, the array of FIG. 14 may be slightly modified to have one of the patterns providing hemispherical pattern coverage (as close as practical) so as to function as the reference element for adaptive processing. Possible modifications to that single pattern include (but are not limited to) the addition of a parasitic radiating element spaced some distance above the slot by a layer of dielectric, or the deforming of the slot layer conductor in such a way as to provide the slot with added height.

Figure 9:
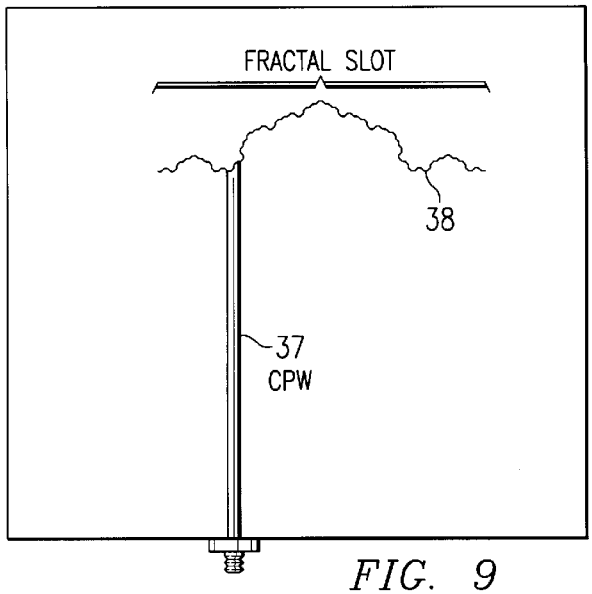
FIG. 9 is a top view of a fractal slot antenna (no orthogonal slot) utilizing a co-planar waveguide (CPW) feed in accordance with the present invention.

Referring to FIG. 9, there is shown a top view of a fractal slot antenna (no orthogonal slot) planar version of a fractal slot 38 fabricated on a 60 mil thick piece of FR4. The fractal slot is 2.45" long (0.29λ@1.425 GHz) with a width of 28 mils. The slot 38 is fed with a co-planar waveguide (CPW) feed 37 that provides a ¼-wave length transformer for converting the input 50 ohms to 100 ohms. This feed can serve as an alternative to the layered coupled feed lines detailed previously. While it is shown without a backing cavity, one could be included. The advantages of this type of feed over the layered coupled feed lines include the fact that it is easier to fabricate and requires only a single etched (milled) layer for the fractal slot and feed. A mode suppression strap/wire (not shown) is used at the output of the CPW feed 37 to suppress an unwanted resonant point at ~800 MHz. The center frequency is 1.425 GHz with an impedance bandwidth of approximately 19% (2:1 SWR). A standard straight slot of identical width and similar construction would be expected to provide a maximum of 8–12% bandwidth.

Figure 15:
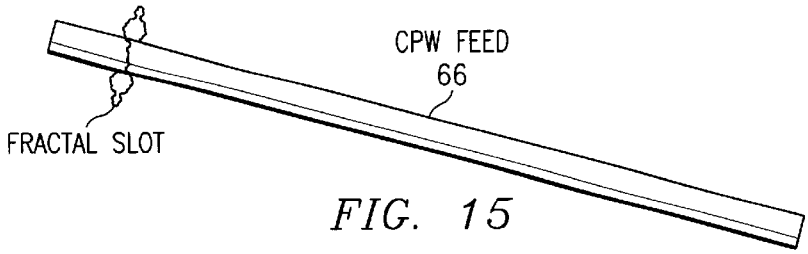
FIG. 15 is an illustration of a cylindrical embodiment of a fractal slot antenna in accordance with the present invention.

Referring to FIG. 15, there is shown a cylindrical fractal slot antenna 64 having a CPW feed 66 as illustrated in FIG. 9. For the antenna 64 of FIG. 15, the slot is "bent" into fractal shape and illustrates that fractal slot antennas may be fabricated to comply with curved surfaces such as found on aircraft.

Although a preferred embodiment of the invention has been illustrated in the accompanying drawings and described in the foregoing detailed description, it will be understood that the invention is not limited to the embodiments disclosed, but is capable of numerous rearrangements and modifications of parts and elements without departing from the spirit of the invention.

What is claimed is:

1. A fractal cross slot broad band antenna, comprising:

a radiating fractal cross slot layer having at least one radiating antenna element comprising a plurality of unit cells;

a first spacer layer configured to define a first cavity, the first spacer layer positioned adjacent one side of the radiating cross slot layer;

a feed layer having feeds equal in number to the at least one radiating antenna element, the feed layer positioned adjacent to the first spacer layer;

a second spacer layer configured to define a second cavity, the second spacer layer positioned adjacent to the feed layer; and a ground plane layer comprising a copper clad surface, said ground plane layer positioned adjacent the second spacer layer.

2. The fractal cross slot broad brand antenna as in claim 1, wherein the first spacer layer comprises an FR4 material.

3. The fractal cross slot broad band antenna as in claim 1, wherein the radiating fractal cross slot layer comprises a copper clad surface on the first spacer layer.

4. The fractal cross slot broad band antenna as in claim 1 wherein the at least one antenna element comprises a repeating unit cell pattern.

5. The fractal cross slot broad band antenna as in claim 4, wherein the unit cell comprises a plurality of slot segments, each slot segment having one end coupled to an adjacent slot segment.

6. The fractal cross slot broad band antenna as in claim 5, wherein each slot segment couples to an adjacent slot segment at an angle of less than 90 degrees.

7. The fractal cross slot broad band antenna as in claim 1, wherein the at least one radiating antenna element comprises a plurality of unit cells coupled together in a continuous pattern, each unit cell coupled to an adjacent unit cell to form a radiating antenna element.

8. The fractal cross slot broad band antenna as in claim 1, wherein the radiating fractal cross slot layer comprises four radiating arms coupled together in a crossed slot configuration.

9. A fractal cross slot broad band antenna array, comprising:

a radiating fractal cross slot layer having a plurality of cross slot antennas each cross slot antenna comprising a plurality of radiating arms;

a first spacer layer configured to define a first cavity, the first spacer layer position adjacent one side of the radiating fractal cross slot layer;

a feed layer having feeds equal in number to the plurality of arms of the fractal slot antenna, the feed layer positioned adjacent to the first spacer layer;

a second spacer layer configured to define a cavity, the second spacer layer positioned adjacent to the feed layer; and a ground plane layer comprising a copper clad surface, said ground plane layer positioned adjacent the second spacer layer.

10. The fractal cross slot broad band antenna array as in claim 9, wherein the first layer comprises an FR4 material.

11. The fractal cross slot broad band antenna array as in claim 9, wherein the radiating fractal cross slot layer comprises a copper clad surface on the first spacer layer.

12. The fractal cross slot broad band antenna array as in claim 9, wherein each of the plurality of fractal slot radiating antenna elements comprises a plurality of unit cells.

13. The fractal cross slot broad band antenna array as in claim 9, wherein the plurality of fractal slot radiating antenna elements comprises a repeating unit cell pattern.

14. The fractal cross slot broad band antenna array as in claim 12, wherein the unit cell comprises a plurality of slot segments, each slot segment having one end coupled to an adjacent slot segment.

15. The fractal cross slot broad band antenna array as in claim 14, wherein each slot segment couples to an adjacent slot segment at an angle of less than 90 degrees.

16. The fractal cross slot broad band antenna array as in claim 9, wherein each of the plurality of radiating fractal slot antenna elements comprises a plurality of unit cells coupled together in a continuous pattern, each unit cell coupled to an adjacent unit cell to form a radiating antenna element.

17. The fractal cross slot broad band antenna array as in claim 9, wherein each of the plurality of radiating fractal slot antennas comprises four radiating arms coupled together in a crossed slot configuration.

18. An antenna element for a fractal slot antenna, comprising:

a unit cell comprising a plurality of slot segments, each slot segment having one end coupled to an adjacent slot segment at an angle of less than 90 degrees; and a plurality of unit cells coupled together in a continuous pattern, each unit cell coupled to an adjacent unit cell to form an antenna element for a fractal slot antenna.

19. The antenna element as in claim 18, wherein each unit cell comprises five slot segments.

20. The antenna element as in claim 18, further comprising a support surface having a copper cladding on one side thereof, the plurality of unit cells formed in the copper cladding of the support surface.

21. A fractal slot antenna, comprising:

a support surface;

a fractal slot antenna element formed on the support surface, the fractal slot antenna element comprising:

a unit cell comprising a plurality of slot segments, each slot segment having one end coupled to an adjacent slot segment at an angle of less than 90 degrees;

a plurality of unit cells coupled together in a continuous pattern, each unit cell coupled to an adjacent unit cell to form a fractal slot antenna element; and a wave guide feed coupled to the fractal slot antenna element.

22. The fractal slot antenna as in claim 21, wherein the wave guide feed comprises a coplanar wave guide.

23. The fractal slot antenna as in claim 21, wherein the support surface comprises a curved supporting structure.

24. The fractal slot antenna as in claim 21, wherein a unit cell comprises five slot segments.

25. The fractal slot antenna as in claim 21, wherein the support surface comprise a copper cladding, and the plurality of unit cells are formed in the copper cladding.

* * * * *

UNITED STATES PATENT AND TRADEMARK OFFICE

CERTIFICATE OF CORRECTION

PATENT NO. : 6,642,898 B1
DATED : November 4, 2003
INVENTOR(S) : Steven D. Eason It is certified that error appears in the above-identified patent and that said Letters Patent is hereby corrected as shown below:

Column 6,
Line 2, change “thank” to -- than --.

Signed and Sealed this

Third Day of August, 2004

JON W. DUDAS
*Acting Director of the United States Patent and Trademark Office*